United States Patent [19]

Ward

[11] Patent Number: 4,852,277

[45] Date of Patent: Aug. 1, 1989

[54] BACKHOE SCRAPER APPARATUS

[76] Inventor: Arthur A. Ward, P.O. Box 64, Saugus, Calif. 91350

[21] Appl. No.: 145,107

[22] Filed: Jan. 19, 1988

[51] Int. Cl.[4] ..... E02F 3/76

[52] U.S. Cl. ..... 37/117.5; 37/DIG. 3; 37/103; 414/912; 299/68; 299/91

[58] Field of Search ..... 37/103, 117.5, DIG. 3, 37/117, 66, 94, 91, 71, DIG. 6, DIG. 16, 80 A, 87; 414/694, 729, 912; 299/89, 91, 93, 39, 40, 64, 68

[56] References Cited

U.S. PATENT DOCUMENTS

| | | | |
|---|---|---|---|
| 2,755,092 | 7/1956 | Donahue | 37/117.5 |
| 3,595,411 | 7/1971 | Ables | 37/103 |
| 3,845,796 | 11/1974 | Moure | 37/117.5 |
| 4,023,288 | 5/1977 | Roe | 37/103 |
| 4,278,368 | 7/1981 | Livesay | 37/117.5 |
| 4,677,772 | 7/1987 | Morelli | 37/103 |

FOREIGN PATENT DOCUMENTS

| | | | |
|---|---|---|---|
| 2027096 | 2/1980 | United Kingdom | 37/117.5 |

*Primary Examiner*—Eugene H. Eickholt
*Attorney, Agent, or Firm*—Roger A. Marrs

[57] ABSTRACT

A scraper roller mounted in a backhoe bucket is provided for attachment to a backhoe tractor or similar boom device with hydraulic pressure line couplings. The roller is attached to supporting bearings at each end and is covered with a plurality of radially extending replaceable cutting blades around its circumference. Attached to one end of the roller is a drive mechanism which extends the length of the bucket and is coupled to a hydraulic motor mounted near the bucket to boom pivot attachment point. The hydraulic motor utilizes fluid coupling attachments for connecting into a hydraulic power system on the tractor. The drive mechanism is covered by a detachable protective shield. Rotation of the roller, assisted when necessary with the downward pressure provided by the backhoe hydraulic piston assembly and the partial weight of the tractor, results in the scraping of a uniform width trench.

6 Claims, 2 Drawing Sheets

BACKHOE SCRAPER APPARATUS

BACKGROUND OF THE INVENTION

1. Field of the Invention

This invention relates to a scraper apparatus used to break up soil and to dig ditches.

2. Brief Description of the Prior Art

During building construction and landscaping, the need arises to lay underground pipelines and conduits. The trenches are frequently long and can be as deep as required. During the trenching, several different soil compositions can be encountered, including hardpan strata which a regular backhoe bucket is unable to break up and will simply slide over. Similarly, while contouring a land area for utility trenches or other purposes, the composition of the soil can go from loose soil to hardpan, resulting in high and low areas, Larger tractor equipment can overcome this difference in soil composition but is not practical from a cost aspect, or if the area is limited in size.

SUMMARY OF THE INVENTION

Accordingly, the above problems and difficulties associated with trenching multi-composition soil and the use of large tractors in confined areas can be overcome by the novel backhoe scraper apparatus of the present invention. A scraper roller is mounted in a backhoe bucket in parallel alignment with a bucket scraping edge that is operated by hydraulic pressure. The roller is attached to supporting bearings at each end and is covered with a plurality of radially extending replaceable cutting surfaces around its circumference. Attached to one end of the roller is a drive mechanism which extends the length of the bucket and is coupled to a hydraulic motor mounted near the bucket to the boom pivot attachment point. The hydraulic motor is fluid coupled for connecting into a hydraulic power system of the tractor. The drive mechanism is covered by a detachable protective shield. Rotation of the roller, assisted when necessary with the downward pressure provided by the backhoe hydraulic piston assembly and the partial weight of the tractor, results in the scraping of a uniform width trench.

Therefore, it is the primary object of the present invention to provide a backhoe tractor bucket for scraping trenches in a construction excavation utilizing the hydraulic system of the backhoe tractor system. Another object of the present invention is to allow trench digging in hardpan soil areas, utilizing a small backhoe tractor where normally a large heavy scraper would be required and yet which may not be suitable to the confined space.

Still another object of the present invention is to provide a novel scraper where the scraping teeth can be replaced as they wear or as the composition of the soil varies.

Another object is to provide a novel ground working apparatus having revolving earth preparation elements immediately ahead of a scraper edge leading into a backhoe bucket whereby hard and difficult soil can be readily excavated.

A further object resides in employing ground condition elements revolving ahead of a backhoe scraping edge so that the ground is initially broken immediately prior to scraping and pickup by the backhoe bucket.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

A more complete understanding of the invention may be had by referring to the following detailed description taken in conjunction with the drawings herein.

Figure 1:
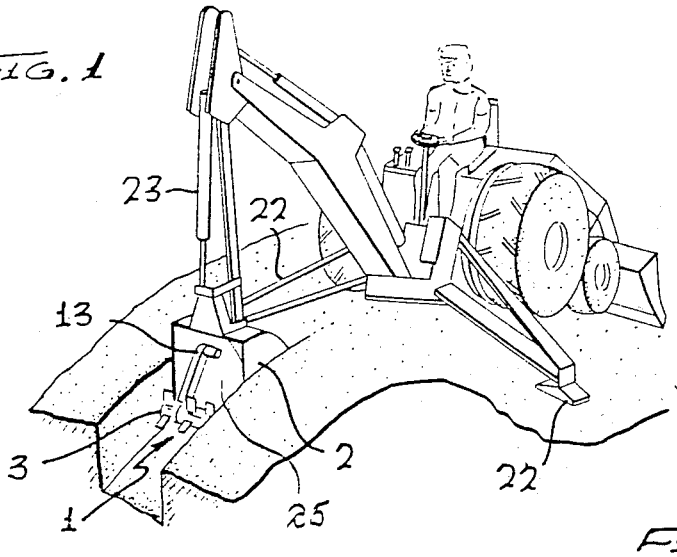
FIG. 1 is a pictorial view of the backhoe scraper of the present invention mounted on a backhoe tractor.

The backhoe bucket cavity is illustrated in FIG. 1 as having an open cavity facing forward; however, the cavity may open facing the driver or rearwardly as well.

DESCRIPTION OF THE PREFERRED EMBODIMENT

Figure 2:
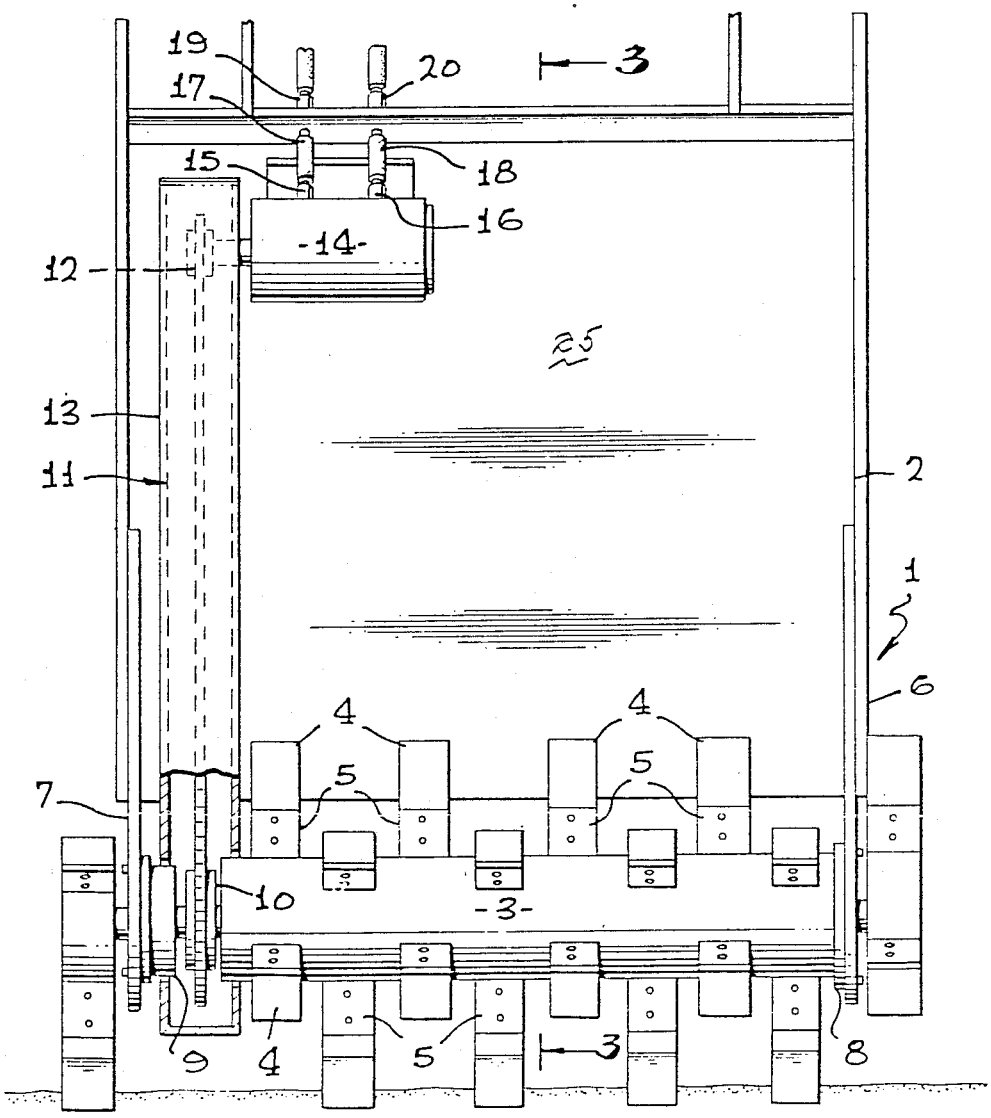
FIG. 2 is a front perspective view of the backhoe scraper.
Figure 3:
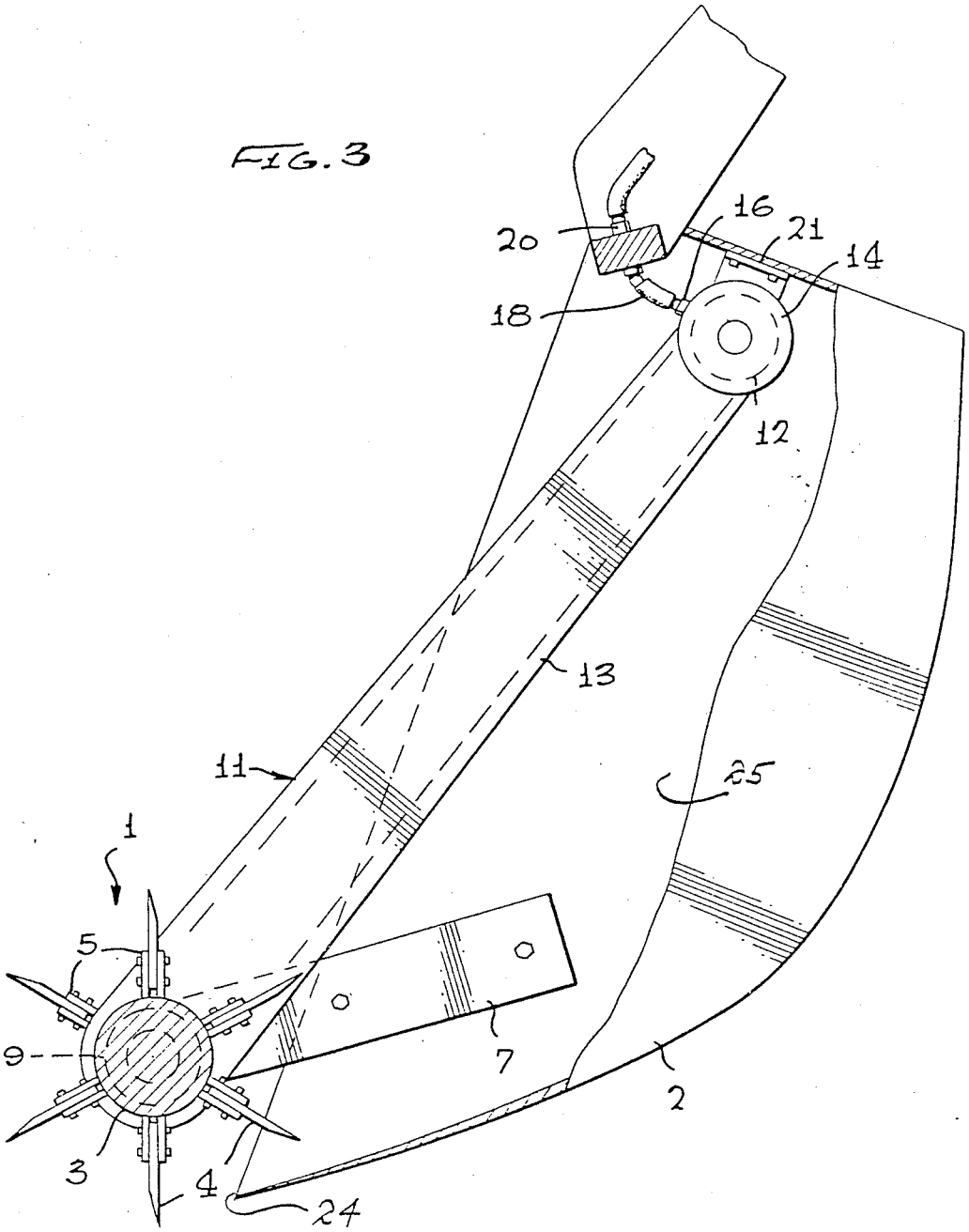
FIG. 3 is a side view of the backhoe scraper of FIG. 2.

Referring now to FIGS. 2 and 3, a backhoe scraper apparatus 1 incorporating the present invention is illustrated which includes a cylindrical roller 3 connected to a backhoe bucket 2 by means of roller axially mounted bearings 8 and 9 which mount to the backhoe bucket 2 at attachment plates 6 and 7. The attachment plates 6 and 7 are thick steel plates which are attached to the sides of the backhoe bucket and serve as a mounting surface for the roller axially mounted bearings 8 and 9. Extending radially from the roller 3 are a plurality of steel cutting teeth 4 which are attached to the roller 3 by means of holding devices 5 which allow individual tooth replacement due to wear or breakage. The roller 3 has a turning axis parallel to a scraping edge 24 of the bucket extending between parallel sides defining a storage cavity.

Roller 3 has an axially mounted motor drive coupling 10 which connects to a drive mechanism 11 that connects to a motor drive coupling 12. The motor drive mechanism can consist of two chain sprockets and a drive chain or a series of universal joints and drive shafts. The entire drive mechanism is covered by a protective cover 13 which prevents debris from intefering with the drive mechanism operation.

The motor drive coupling 12 is attached to a hydraulic motor 14 which is mounted to the backhoe bucket by a bracket 21 in the area where the backhoe bucket attaches to the tractor boom. The hydraulic motor 14 has a hydraulic high pressure coupling 15 which attaches to a hydraulic hose 17 that terminates in a hydraulic coupling 19 directly connected into the tractor hydraulic high pressure system. The hydraulic motor 14 has a hydraulic return pressure coupling 16 which attaches to a hydraulic hose 18 which terminates in a hydraulic coupling 20 which connects to the tractor hydraulic return system.

In a preferred embodiment of the present invention, the cylindrical roller 3 is a solid steel bar which will not distort when the holding devices 5 are welded to the roller. The holding devices 5 can accept various width cutting teeth 4 made of carbide steel or other materials heat treated to achieve any desired hardness. The axially mounted bearings 8 and 9 are of pressed bearing construction which slide over the ends of the roller 3. The bearings are a pressed fit on side plates 6 and 7. Attachment plates 6 and 7 are 1 inch thick in order that no deterioration occurs during bearing installation and that the bearings are fully supported. The attachment plates 6 and 7 are attached to the sides of the backhoe bucket by bolts; the attachment plates alignment in the backhoe bucket results in the cylinder roller 3 being located near the cutting edge 24 of the backhoe bucket in parallel spaced-apart relationship.

The motor drive coupling 10 is slid axially over cylindrical roller 3 and is a pressed fit to the roller. The motor drive coupling 10 consists of a gear whose teeth will engage the links of a drive mechanism 11 consisting of a linked roller chain. The motor drive coupling 10 consists of a gear whose teeth will engage the links of the drive mechanism and which is attached to the hydraulic motor central shaft. The motor drive coupling 10, the drive mechanism 11, and the motor drive coupling 12 are encased in a four-sided protective cover 13, made out of ¼ inch metal. The protective cover attaches to the side of the backhoe bucket, which forms two more sides to the protective cover, totally enclosing the drive mechanism from exposure to soil and debris.

The hydraulic motor 14 is a commerically available drive motor which is mounted to a bracket welded to the backhoe bucket. The drive motor has a high pressure input port which accepts the high pressure coupling 15. The high pressure coupling has an integral hydraulic hose which terminates in a quick release hydraulic coupling 19 which attaches to the backhoe tractor hydraulic system. The drive motor has a hydraulic pressure return port which accepts the hydraulic return pressure coupling 16. The hydraulic return pressure coupling has an integral hydraulic hose which terminates in a quick release hydraulic coupling 20 which connects to the backhoe tractor hydraulic return system.

FIG. 1 shows the backhoe scraper in the scraping position. The backhoe tractor is placed in position to begin scraping a trench. The scoop bucket is lowered and the outriggers 22 are used to balance the tractor. The trust piston 23 is extended to apply downward pressure on the scraper as the cylindrical roller 3 begins scraping. The soil which is broken loose due to the cutting action of the scraper teeth 4 and the pressure applied by the thrust piston 23 and the weight of the tractor is projected into the backhoe bucket until it is full. Scraping is then terminated and the full bucket is off loaded to the side of the trench.

It is understood from the foregoing description that the scraper of the present invention provides several important benefits over a simple backhoe tractor bucket system. Using the cutting capabilities of the described apparatus, which can include carbide tool cutting teeth, soil and any encountered rocks or hardpan can be broken up. Presently, if hardpan or rocks are encountered, and the backhoe bucket is unable to break these materials loose, larger equipment is required for further trenching. Larger equipment results in an immediate cost increase and might not even be usable if the work area is limited in size. The only other solution has been to bring in manual labor to break up the rock or hardpan. The cost in time and labor is clear. The present invention allows a single operator with the access capabilities of a backhoe tractor to complete the required trenching. Further, while landscape grading, hardpan is frequently encountered and a regular backhoe tractor bucket will skip over the hardened area. The present invention enables the backhoe operator to scrape the hardpan area into the desired contour.

Although FIG. 1 shows the revolving ground preparing elements or pins 3 and the backhoe cavity facing forward, this is illustrated for clarity and ease of illustration. The cavity, as indicated by number 25, may face rearwardly towards the boom and driver/operator of the apparatus. This latter orientation would be more in keeping a backhoe digging procedure.

However, it is important to note that the revolving ground preparing elements, such as blades 4, may take the form of a removable conical pins. The elements 4 break up the ground immediately ahead of the bucket scraper edge 24 so that the scraper can load the broken up soil directly into the cavity 25 of the bucket. The elements are powered so that hardpan soil is readily broken up into chunks during a scraper procedure so that the edge 24 immediately follows to pick up the chunks for deposit into the cavity 25. Therefore, separate runs of the apparatus over the ground is not required as is encountered in conventional procedures.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a backhoe tractor for dislodging of and collection of soil during a trench excavation procedure, including a hydraulic power system and a hydraulically actuated boom assembly mounted on said backhoe tractor, the improvement which comprises the combination:

a bucket pivotally connected to said boom assembly having a terminating edge between opposite sides leading into a storage cavity for gathering and receiving hardpan soil;

an elongated cylindrical roller rotatably carried on said bucket opposite sides parallel to and facing said terminating edge of said bucket in fixed spaced relationship and having a plurality of outwardly and radially projecting elements arranged in staggered rows and columns from said roller immediately ahead of said terminating edge;

each of said elements is characterized as being replaceable and deployed about the circumference of said roller;

motor means carried on said bucket for driving said roller and including means of connection to said hydraulic power system of the backhoe tractor; and said rotatable roller disposed with respect to said bucket storage cavity for reception and collection of dislodged soil directly conducted via said plurality of blades.

2. Apparatus for use on earth-working equipment in trenching and contouring soil, comprising the combination of:

a boom assembly operable by a hydraulic power system pivotally carrying a bucket at one end thereof;

a terminating edge carried on said bucket defined between two parallel and spaced-apart sides leading into a storage cavity;

roller means movably carried on said bucket between said parallel sides facing said backhoe bucket terminating edge in close spaced-apart relationship;

said roller means including a plurality of outwardly and radially disposed blades arranged in staggered rows and columns constituting cutting surfaces about the circumference of a roller for soil engagement immediately ahead of said bucket storage cavity;

means disposed on said roller means for replaceably connecting each of said blades to said roller means;

attachment means for releasably connecting said roller means to said bucket allowing selected rotational movement of said roller means ahead of said bucket; and a hydraulic motor means carried on said bucket operably coupled to said roller means in driving relationship thereto for rotating said roller with said plurality of blades whereby soil is conducted from said blades directly into said bucket storage cavity.

3. The invention as defined in claim 2 wherein:

said hydraulic power system connected to operate both said boom assembly and said motor means for said roller means.

4. The invention as defined in claim 3 wherein:

said roller means is an elongated cylindrical roller having a turning axis substantially parallel to said scraping edge so that said roller and said rotating blades face said scraper edge and said storage cavity.

5. The invention as defined in claim 2 wherein:

said projecting blades revolve with said roller immediately ahead of said bucket terminating edge for ground engaging and breakup prior to collection into said bucket storage cavity.

6. The invention as defined in claim 5 including:

a pair of rigid arms secured to said bucket sides respectively movably supporting said roller therebetween for revolving ahead of said terminating edge and said bucket storage cavity; and said arms projecting ahead of said bucket terminating edge mounting said roller so that its turning axis is parallel to said terminating edge whereby dislodged soil by said revolving blades is conducted into said bucket storage cavity.

* * * * *